US010342267B2

(12) United States Patent
Habert

(10) Patent No.: US 10,342,267 B2
(45) Date of Patent: Jul. 9, 2019

(54) DUAL LAYER SLIPPER SOCK AND METHOD OF MANUFACTURING SAME

(71) Applicant: Jacques Moret, Inc., New York, NY (US)

(72) Inventor: Joseph Habert, Brooklyn, NY (US)

(73) Assignee: Jacques Moret, Inc., New York, NY (US)

( * ) Notice: Subject to any disclaimer, the term of this patent is extended or adjusted under 35 U.S.C. 154(b) by 104 days.

(21) Appl. No.: 14/817,867

(22) Filed: Aug. 4, 2015

(65) Prior Publication Data

US 2016/0029705 A1 Feb. 4, 2016

Related U.S. Application Data

(60) Provisional application No. 62/032,914, filed on Aug. 4, 2014.

(51) Int. Cl.
*A43B 3/10* (2006.01)
*A41B 11/00* (2006.01)

(52) U.S. Cl.
CPC ..... *A41B 11/007* (2013.01); *A43B 3/101* (2013.01)

(58) Field of Classification Search
CPC ..... A41B 11/007; A43B 3/01
See application file for complete search history.

(56) References Cited

U.S. PATENT DOCUMENTS 1,803,554 A * 5/1931 Knilans ..... A43B 5/00 36/114
D86,152 S * 2/1932 Bellak ..... 66/171
2,147,197 A * 2/1939 Glidden ..... A43B 1/02 36/3 A
2,675,631 A * 4/1954 Doughty ..... A43B 1/04 36/12
2,686,376 A * 8/1954 Burkholz ..... A43B 3/02 36/101
2,857,688 A * 10/1958 Haase ..... A43B 3/242 2/139
2,904,980 A * 9/1959 Stinson ..... A41B 11/10 2/239
3,259,915 A * 7/1966 Dison ..... A41B 11/005 2/239
3,503,077 A * 3/1970 Connelly ..... A41B 11/00 2/239
3,990,115 A * 11/1976 Nester ..... A41B 11/00 2/239

(Continued)

FOREIGN PATENT DOCUMENTS

CA 2830322 A1 * 11/2014 ..... A41B 11/005

*Primary Examiner* — Richale L Quinn

(74) *Attorney, Agent, or Firm* — Mandelbaum Silfin Economou LLP

(57) ABSTRACT

A slipper sock is formed from an outer pouch and an inner pouch shaped to receive and encapsulate a person's foot. A border around an opening in the inner pouch is placed over a border around an opening in the outer pouch. The inner pouch and outer pouch are affixed together at the interface of the overlapping borders surrounding the openings of the pouches. The inner pouch which can be made of pile material is then inserted through the opening of and into the outer pouch and spread to conform to the shape of the outer pouch. The border of the inner pouch can form a collar surrounding the opening of the outer pouch.

12 Claims, 11 Drawing Sheets

(56) References Cited

U.S. PATENT DOCUMENTS

| | | | | | |
|---|---|---|---|---|---|
| 4,575,954 | A * | 3/1986 | Bye | A61F 5/0111 | 2/240 |
| 4,736,531 | A * | 4/1988 | Richard | A43B 23/07 | 36/10 |
| 4,870,708 | A * | 10/1989 | Staley | A41B 11/02 | 2/404 |
| 4,967,494 | A * | 11/1990 | Johnson | A41B 11/005 | 2/239 |
| 5,086,576 | A * | 2/1992 | Lamson | A43B 5/14 | 36/131 |
| D347,518 | S * | 6/1994 | Stewart | D2/920 | |
| 5,319,869 | A * | 6/1994 | McDonald | A43B 5/00 | 36/114 |
| 5,617,585 | A * | 4/1997 | Fons | A41B 11/007 | 2/239 |
| 6,041,443 | A * | 3/2000 | Pas | A41B 11/005 | 2/239 |
| 6,308,438 | B1 * | 10/2001 | Throneburg | A43B 1/02 | 36/11 |
| 6,880,268 | B2 * | 4/2005 | Chen | A41B 11/007 | 36/10 |
| 6,931,762 | B1 * | 8/2005 | Dua | A43B 1/04 | 12/142 G |
| 7,434,336 | B2 * | 10/2008 | Kosted | A43B 1/0081 | 36/10 |
| 8,701,311 | B2 * | 4/2014 | Barnhart | A43B 23/24 | 36/1.5 |
| 9,532,624 | B2 * | 1/2017 | Lap | A43B 7/32 | |
| 2006/0248748 | A1 * | 11/2006 | Warren | A43B 1/0081 | 36/9 R |
| 2009/0188020 | A1 * | 7/2009 | Beaumont | A41B 11/001 | 2/239 |

* cited by examiner

DUAL LAYER SLIPPER SOCK AND METHOD OF MANUFACTURING SAME

BACKGROUND OF THE INVENTION

It is known in the art to form a slipper sock which has the characteristics of both a slipper and a sock. The body of the slipper sock is formed to receive and conform to in the shape of a foot. Like a slipper, the underside of the sock often has a sole of heavy material to enable comfortable walking, preventing rapid wear on the bottom, and protecting the underside of the foot from harm when walking on irregular surfaces.

Socks are generally worn inside of a shoe or other footwear which protects the material from which the sock is made and the foot of the wearer. Slipper socks are worn without other footwear and engage the ground on which the wearer walks or stands. Prior art slipper socks are often characterized by an outsole fastened to the underside of the slipper sock body which forms the sock portion of the slipper sock in order to insulate and protect the wearer's foot from the ground.

Depending on how the outsole is fastened to the sock portion of a slipper sock, an insole must sometimes be added to the interior of the sock body to provide a barrier between the fasteners used to adhere the outsole to the sock portion of the slipper sock as such fasteners may penetrate or, at least, be felt through the bottom of the sock portion of the slipper sock.

It is also desirable to enhance the warmth of a slipper sock by insulating the sock portion of the slipper sock from the ambient temperature, e.g., when walking on a cold floor or otherwise wearing the slipper sock in a cold environment. It is further desirable to be able to construct the slipper sock with the use of conventional and readily available sock manufacturing machinery.

SUMMARY OF THE INVENTION

The present invention overcomes the shortcomings of prior art slipper socks in providing a slipper sock formed from two pouches shaped to receive and encapsulate a person's foot. The slipper sock has an outer pouch and an inner pouch within the outer pouch, each with a body having a chamber for receiving the foot and an opening through which the foot may be inserted. Like a conventional sock, the outer pouch is knitted in the form of a tube and one end of the tube at the toe, is sewn closed. The inner pouch is can the woven into a web of material which is cut and sewn to form a three-dimensional pouch.

The outer pouch has an integral upper and lower with a narrow opening in the upper for receiving the foot. The inner pouch has a shape similar to that of the outer pouch. The material from which the inner pouch is made can have a high pile with a fluffy texture for comfort, warmth and to give the slipper sock body.

The outer and inner pouches are horizontally seamed to maintain creases on toe portions of the pouches and vertically seamed to maintain creases on heel portions of the pouches.

The inner pouch and outer pouch are fastened together proximate their openings preferably by stitches or a bonding adhesive at borders surrounding the pouch openings. Other fastening means may be used, e.g., snaps, or hook and loop fasteners. The outer pouch can be fastened to the inner pouch solely where the margins surrounding the respective pouch openings interface, without any fasteners between the sole portion of the inner pouch and the sole portion of the outer pouch. In order to secure the inner pouch within the outer pouch, the inner pouch and outer pouch may be sewn together at one or more locations beneath their openings, e.g., at the toes of the pouches.

The inner pouch is inserted into the outer pouch with the inner pouch border being folded over the outer pouch border thereby forming a collar around the outer pouch opening. An elastic band surrounding the openings in the pouches can be inserted between the overlapping borders where it is hidden from view before affixation of the borders together. After the inner pouch is inserted into the outer pouch it is spread to fill the outer pouch chamber.

The bottom of the slipper sock is preferably covered with a single gripper covering substantially the entire underside of the outer pouch or with spaced grippers, all made of a rubber-like high friction material for preventing slips and falls.

It is therefore an object of the invention to provide a slipper sock that can be made with conventional sock making machinery.

Another object of the invention is to provide a slipper sock that can accommodate a wide range of foot sizes.

Still another object of the invention is to provide a slipper sock with a lining than can be made from a variety of materials.

A further object of the invention is to provide a slipper sock with a lining that forms a collar around the foot of the wearer.

Still a further object of the invention is to provide a slipper sock that is light in weight and highly flexible for comfort with one or more grippers to prevent sliding.

Other and further objects of the invention will be apparent from the following detailed description of a preferred embodiment of the invention.

DESCRIPTION OF THE PREFERRED EMBODIMENTS

Figure 1:
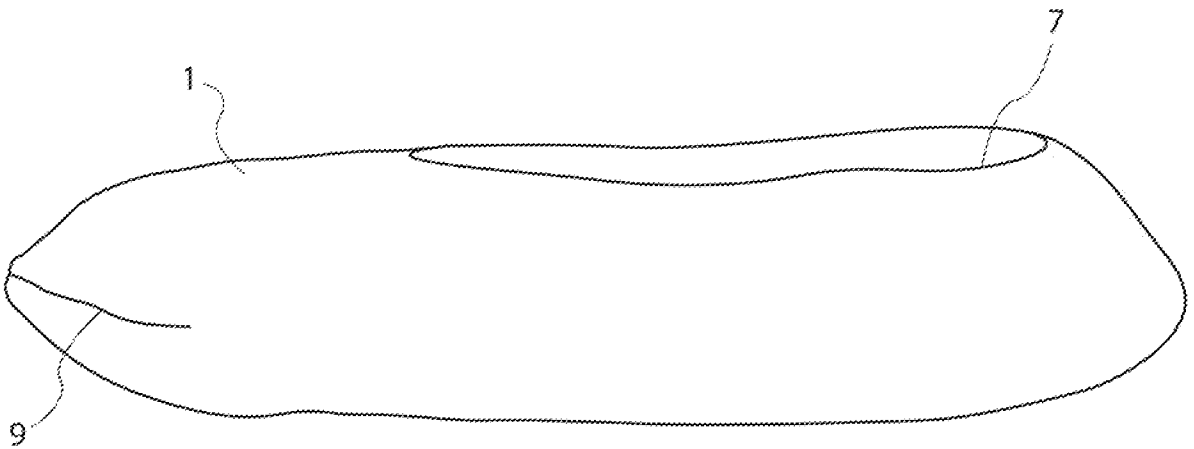
FIG. 1 is a side elevation view of a component of the slipper sock of the preferred embodiment of the invention.

Referring to FIG. 1 of the drawings there is shown a first component of a slipper sock in accordance with the invention, namely, an outer pouch 1 knitted from yarns into a tube on a conventional sock manufacturing machine in a manner similar to that employed in the manufacture of socks. As in the case of socks, the tube is closed at on end, normally by sewing, to form the toe portion of the sock.

In order to make a single slipper sock in accordance with the invention that can accommodate a wide range of foot sizes, the yarns from which the body of the pouch 1 is knitted may include, in addition to cotton, wool, rayon, or any one of a number of natural or synthetic materials commonly used to produce a sock or slipper, spandex fibers or other elastic materials. The elastic yarns make the slipper sock resilient and enable it to be stretched during placement on a foot and to then contract to conform to the shape of the foot for a snug fit. It is preferred that the elastic yarns comprise 2% of the total yarn content of the outer pouch with 1-3% being effective.

Figure 2:
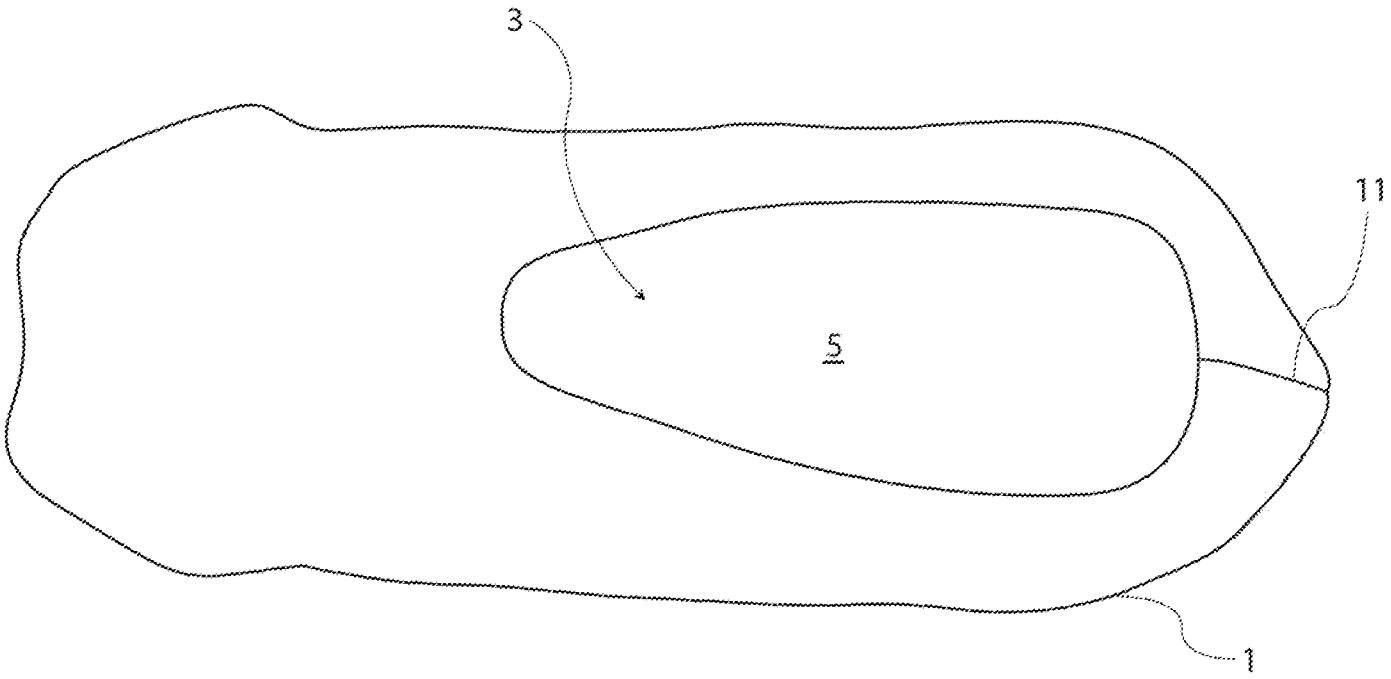
FIG. 2 is a top plan view of the component of the slipper sock of the preferred embodiment of the invention shown in FIG. 1.

Referring additionally to FIG. 2 of the drawings, it can be seen that at the top of the slipper sock outer pouch there is an opening 3 to a chamber 5 within the outer pouch 1 in which a foot is to be received. The opening 3 is surrounded by a border 7 in the outer pouch 1.

The foot of the wearer of the slipper sock is passed through the opening 3 into the chamber 5 as the slipper sock is placed on the wearer's foot. In order to maintain the shape of the outer pouch 1 forming the slipper sock upper after it is formed into a tubular body, a substantially horizontal seam 9 is sewn to close and maintain a crease on the front or toe portion of the slipper sock outer pouch 1. A substantially vertical seam 11 is sewn to maintain a crease at the rear or heel portion of the outer pouch 1 of the slipper sock.

Figure 3A:
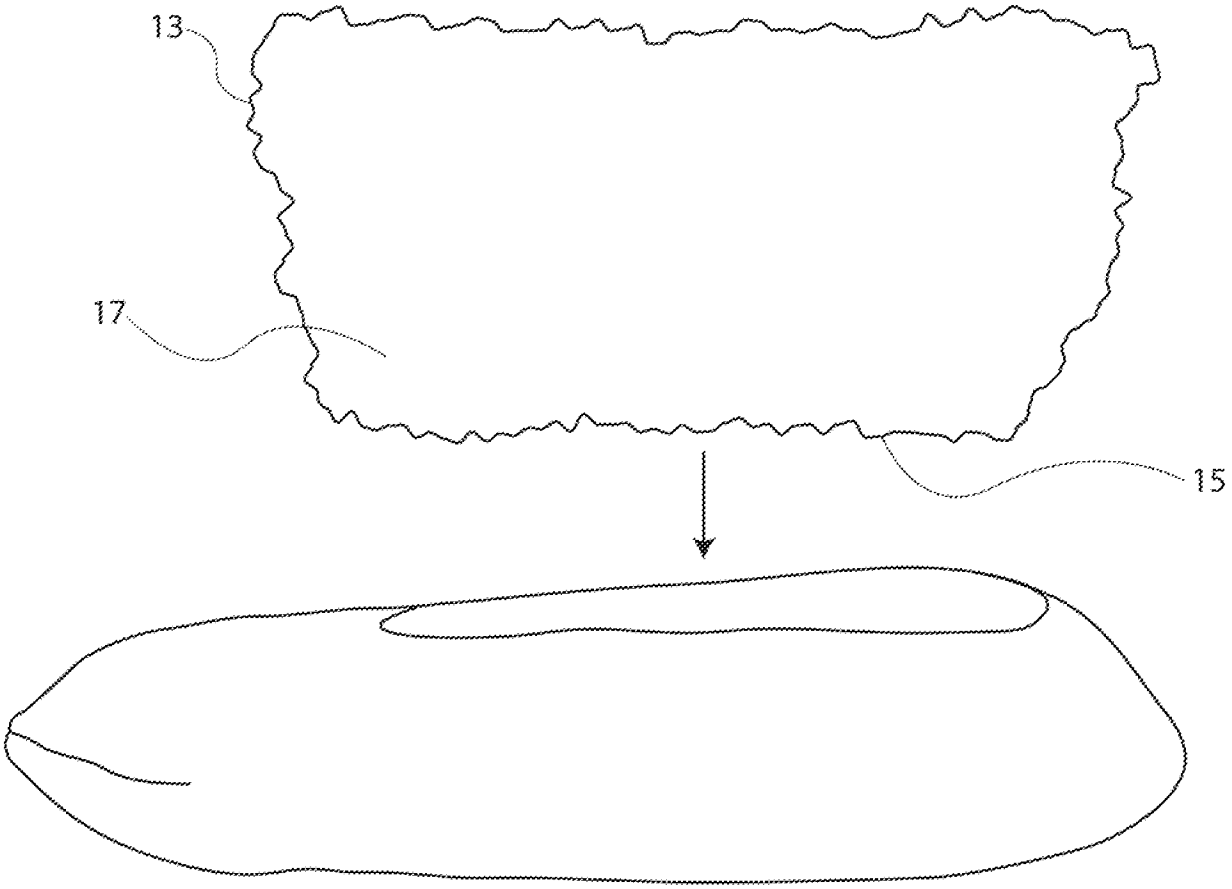
FIG. 3A is a side elevation view of the slipper sock of the preferred embodiment of the invention with a second component shown in an initial disposition during assembly.

As can be seen in FIG. 3A an inner pouch 13 is formed for attachment to, and insertion into, the outer pouch 1. The inner pouch 1 may be woven into a thick web of material having a high pile with a fluffy feel and being a good insulator for maintaining warmth and comfort within the slipper sock.

The inner pouch 13 need not be fitted as rigidly or with the same degree of elasticity as the outer pouch 1 since the shape of the outer pouch 1 forms the shape of the slipper sock and the inner pouch is sufficiently pliable to conform to the shape of the outer pouch 1 when the inner pouch is inserted into the outer pouch 1.

Figure 3B:
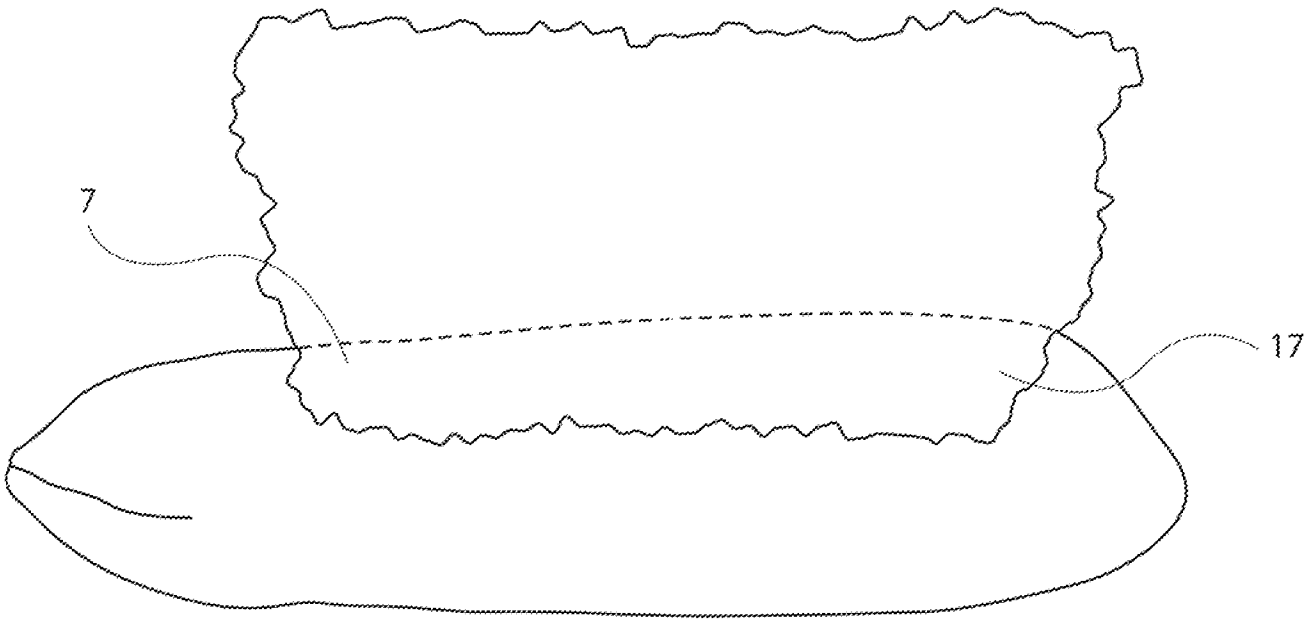
FIG. 3B is a side elevation view of the slipper sock of the preferred embodiment of the invention with the second component shown in an intermediary disposition during assembly.

As can be seen in FIG. 3A, there is also an opening 15 in the pile fabric inner pouch 13 about which there is a border 17 that is placed over the border 7 surrounding the opening 3 in the outer pouch 1. After being positioned over the border 7 surrounding the opening in the outer pouch 1, thereby forming an interface between the border 17 of the inner pouch and the border 7 of the outer pouch 1 as shown in FIG. 3B, the inner pouch 1 is affixed to the outer pouch 13 by sewing or through the use of an adhesive along the circumference of the interface between the border 17 of the inner pouch and the border 7 of the outer pouch 1. Optionally, an elastic band surrounding the openings in the pouches can be inserted between the overlapping borders where it is hidden from view before affixation of the borders together. In order to prevent separation of the inner pouch from the outer pouch after assembly, the inner pouch and outer pouch may be sewn together, preferably at the toes, and optionally at one or more other locations.

Figure 4:
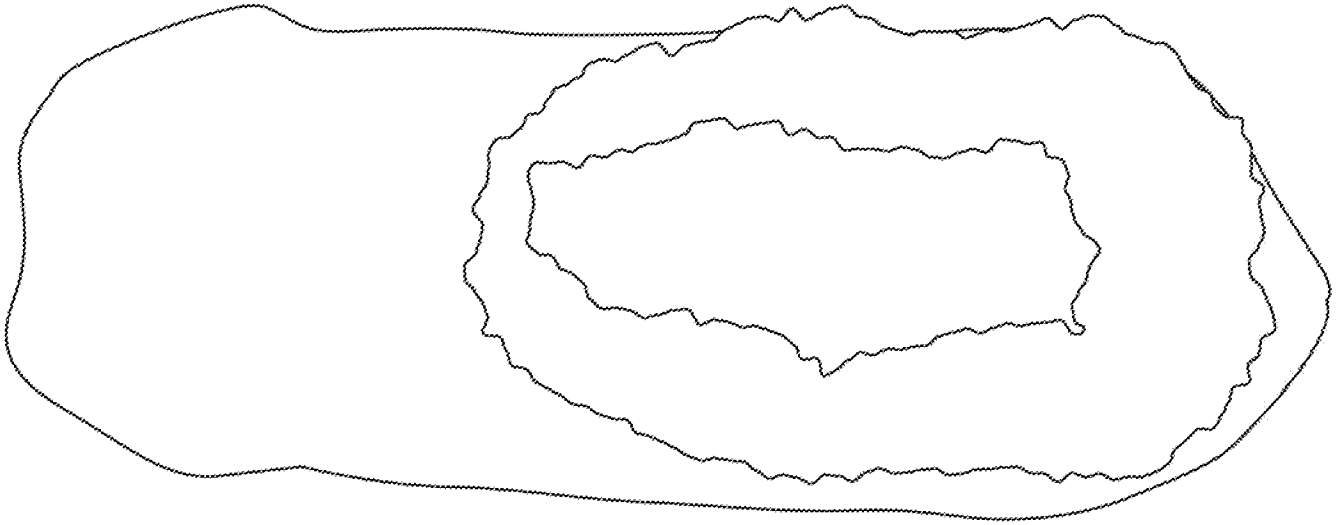
FIG. 4 is a top plan view of the slipper sock of the preferred embodiment of the invention after completion of assembly.

Referring now to FIG. 4 of the drawings, after the inner pouch 13 is affixed to the outer pouch 1 as shown in FIGS. 3A and 3B, the inner pouch 13 is inserted into the outer pouch 1 through the opening in the outer pouch 1 and spread to fill the volume of the chamber 5 in the outer pouch 1 so that the inner pouch 13 is in engagement with and conforms to the shape of the outer pouch 1. The inner pouch 1 is spread laterally so that its side walls engage the side walls of the outer pouch 1 and longitudinally so that the toe and heel regions of the inner pouch 13 engage the toe and heel regions of the outer pouch 1, respectively. The result is a dual layer slipper sock with the outer pouch 1 forming the major part of the exterior and the inner pouch 13 forming an interior liner.

By virtue of the insertion of the inner pouch 13 into the outer pouch 1, after the inner pouch 13 and outer pouch 1 have been fastened together, with the border 7 surrounding the opening in the outer pouch 1 received within the border 17 surrounding the opening in the inner pouch 13, the border 17 of the inner pouch 13, at the interface where the outer pouch 1 and inner pouch 13 are sewn together, remains outside of the opening 3 in the outer pouch 1 to form a comfortable and attractive looking pile collar that surrounds the ankle of the foot of the wearer of the slipper sock.

Figure 5:
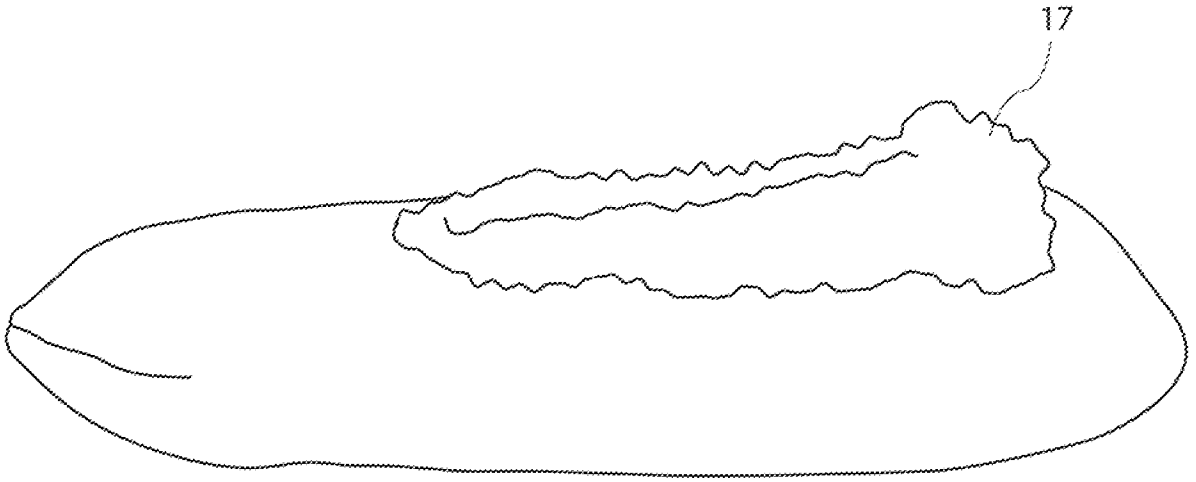
FIG. 5 is a side elevation view of the slipper sock of the preferred embodiment of the invention.
Figure 6:
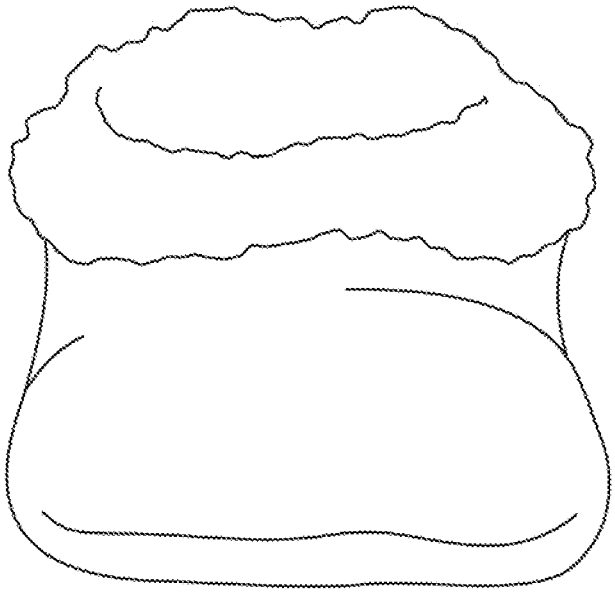
FIG. 6 is a front elevation view of the slipper sock of the preferred embodiment of the invention.
Figure 7:
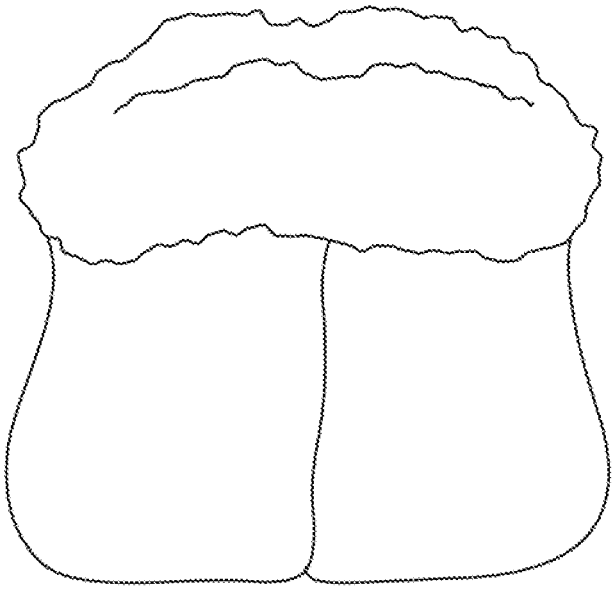
FIG. 7 is a rear elevation view of the slipper sock of the preferred embodiment of the invention.

As can be seen in FIGS. 5-7, the pile collar surrounding the opening in the slipper sock covers the border 7 that surrounds the opening 3 in the outer pouch 1 so that the border 7 does not cut into the ankle of the wearer which is instead engaged and cushioned by the fluffy pile material of the inner pouch 13 that overflows from the interior of the slipper sock to its exterior.

Figure 8:
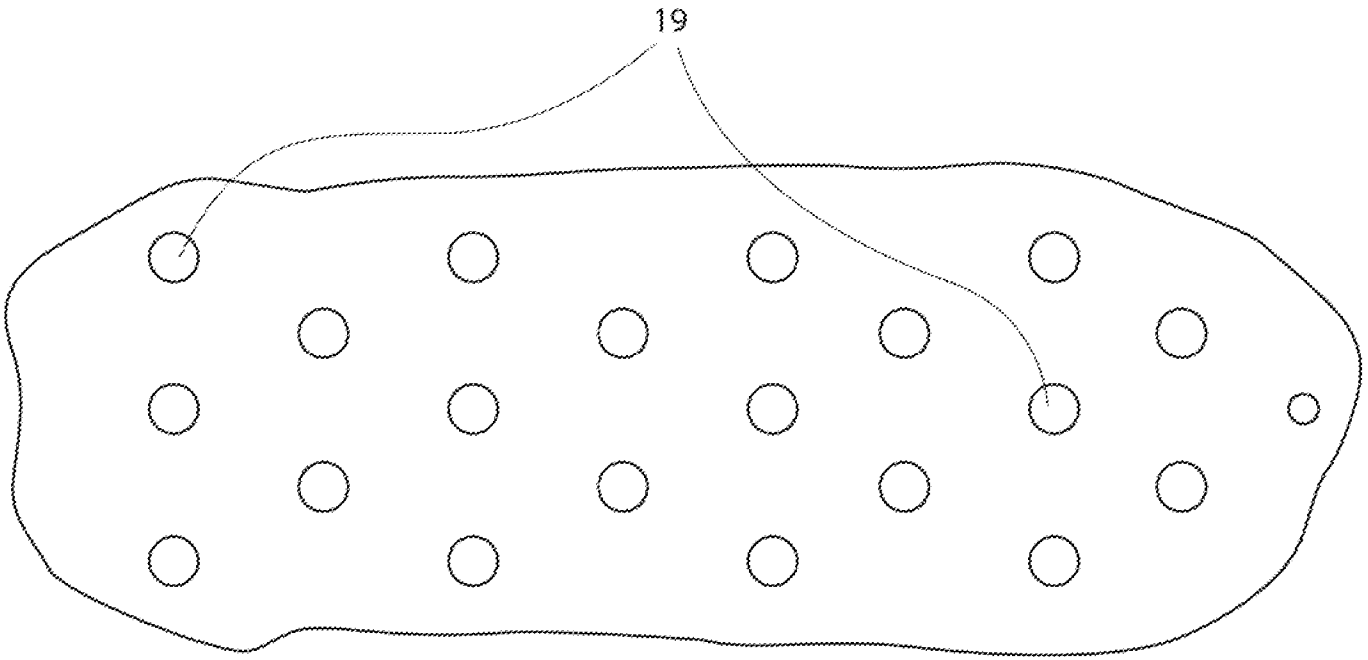
FIG. 8 is a bottom plan view of the slipper sock of the preferred embodiment of the invention.

As can be seen in FIG. 8 of the drawings, the underside of the outer pouch 1 which forms the outer of the slipper sock has optionally distributed over its surface substantially equally spaced grippers 19 made of a natural or synthetic rubberlike material to provide a high friction gripping surface in order to prevent slips and falls when walking on a smooth floor. In the preferred embodiment of the invention, the grippers 19 are circular. However, the grippers may be of other shapes. Moreover, single gripper may be applied to the underside of the outer pouch, e.g., covering substantially its entire area. It is to be appreciated that grippers of various shapes, sizes and spacings may be employed.

Figure 9:
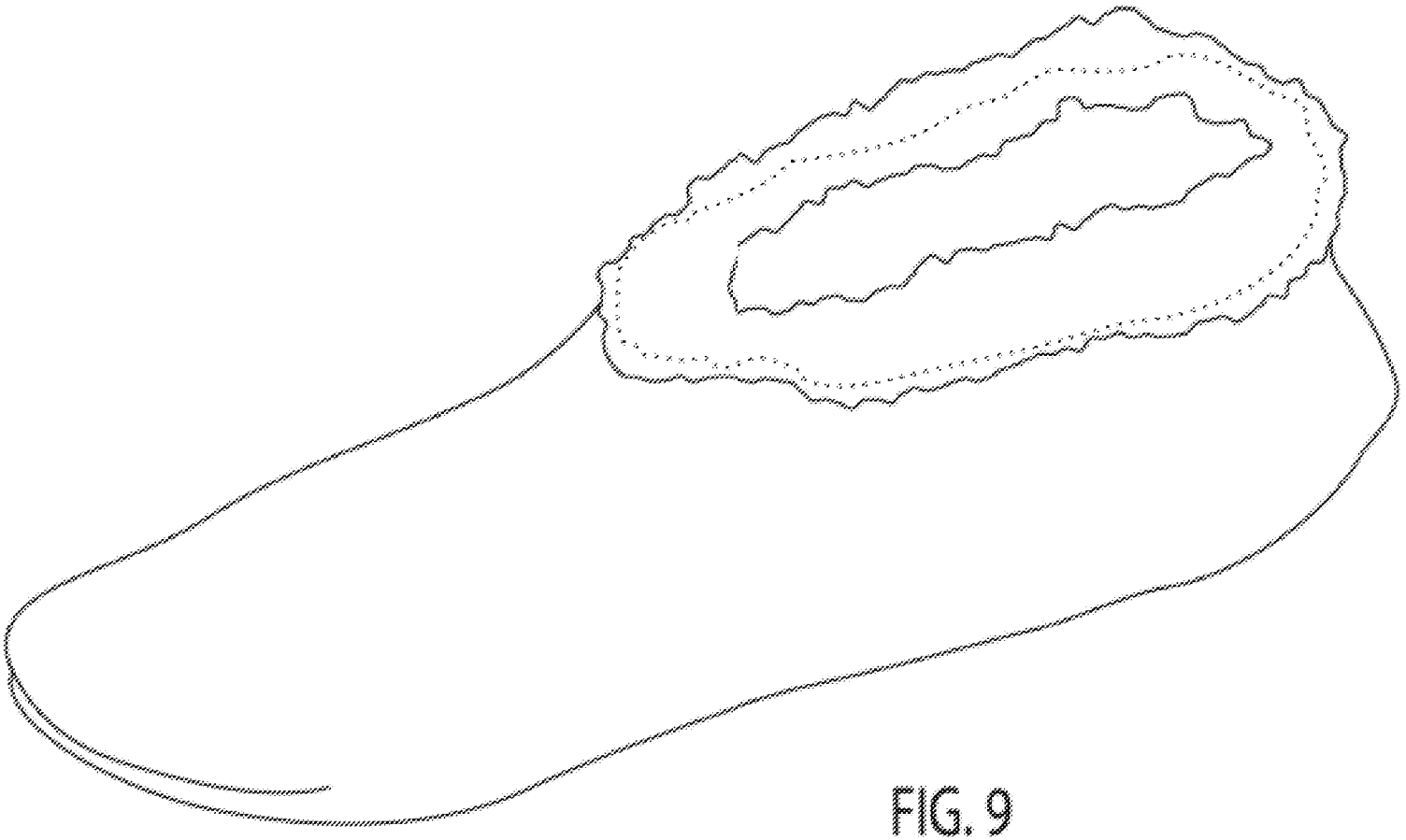
FIG. 9 is a perspective view of the slipper sock of the preferred embodiment of the invention.

Referring to FIG. 9 of the drawings it can be seen that the finished dual layer slipper sock, with inner and outer pouch borders stitched together, provides a highly pleasing aesthetic appearance as well as functional warmth and comfort and protection to the wearer.

The collar surrounding the inner pouch opening can has a substantially uniform height in the embodiment shown in FIGS. 4-7. However, the slipper sock of the invention may be manufactured with a collar having variable heights. Moreover, the slipper sock of the invention need not have a collar.

The profile and presence of the collar are determined by the height of the inner pouch. As the height of the inner pouch increases about the inner pouch opening relative to the height of the outer pouch, the margin by which the inner pouch height exceeds the outer pouch height increases, and the height of the collar formed when the inner pouch is folded over the border of the outer pouch opening is also increased.

Figure 10:
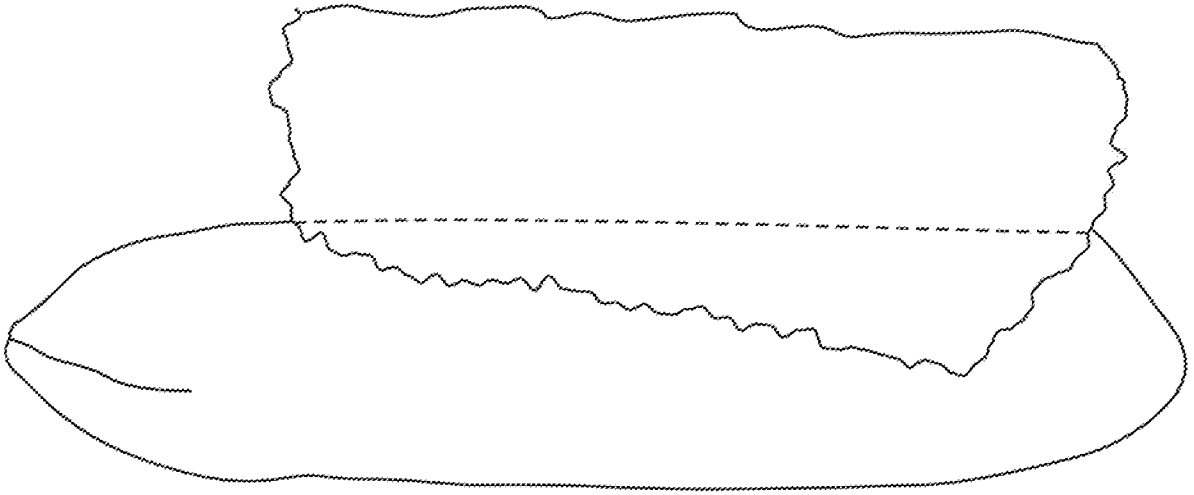
FIG. 10 is a side elevation view of the slipper sock of the preferred embodiment of the invention with the second component shown in an intermediary disposition during assembly in a first alternate embodiment of the invention.

The collar surrounding the inner pouch opening need not have a uniform height. As can be seen in FIG. 10, the height of the inner pouch at the inner pouch opening can be sloped, e.g., so that the height of the rear of the inner pouch is greater than the height of the front of the inner pouch. When the inner pouch is inserted into the outer pouch, the result is a collar that progressively increases in height from the front of the slipper sock toward the rear of the slipper sock.

Figure 11:
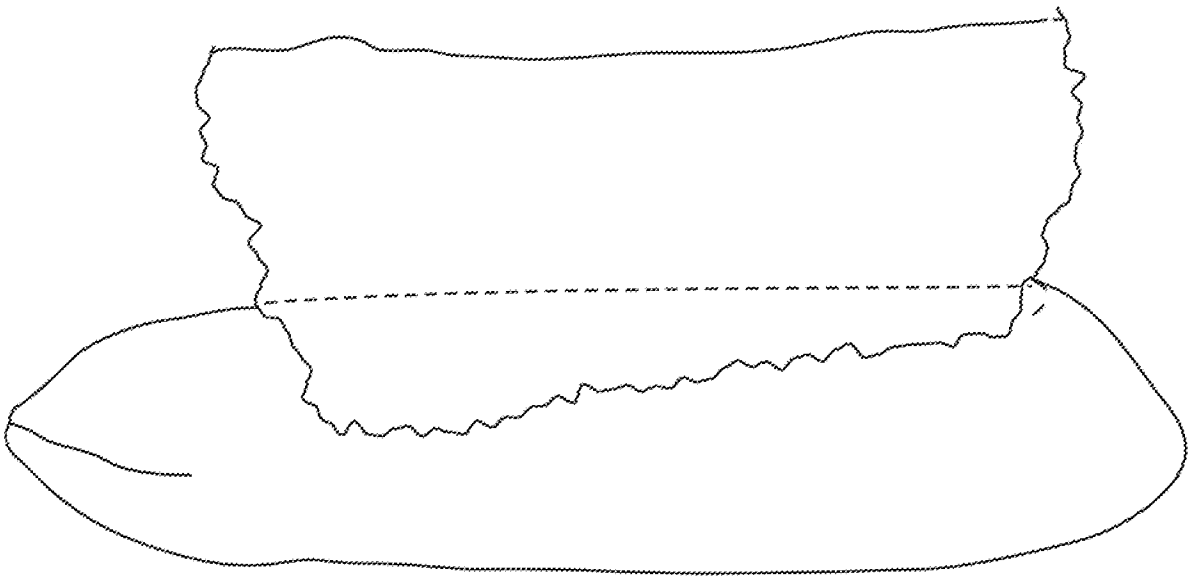
FIG. 11 is a side elevation view of the slipper sock of the preferred embodiment of the invention with the second component shown in an intermediary disposition during assembly in a second alternate embodiment of the invention.

Alternatively, as can be seen in FIG. 11, the height of the inner pouch at the inner pouch opening can be sloped, e.g., so that the height of the rear of the inner pouch is lower than the height of the front of the inner pouch. When the inner pouch is inserted into the outer pouch, the result is a collar that progressively decreases in height from the front of the slipper sock toward the rear of the slipper sock.

The inner pouch and outer pouch can be formed with substantially equal heights where no collar surrounding the inner pouch opening is desired. In the latter cases, the outside of the margin surrounding the opening in the inner pouch can be affixed to the inside of the margin surrounding the opening in the outer pouch.

Except as described above, the embodiments of FIGS. 10 and 11 are identical to the embodiment of FIGS. 1-9.

It is to be appreciated that the foregoing description is of a preferred embodiment of the invention to which modifications and variations may be made without departing from the spirit and scope of the invention.

What is claimed is:

1. A slipper sock shaped to receive and encapsulate a person's foot, said slipper sock comprising an outer pouch with a body having, at a top of said slipper sock, an entranceway to a chamber for receiving said foot, said outer pouch being closed at a bottom of said slipper sock, an exterior surface, an interior surface forming a surface of said chamber and a shape conformable to said foot, an inner pouch with a body received within said chamber of said outer pouch body, said inner pouch body having, at said top of said slipper sock, an entranceway to a chamber for receiving said foot, said inner pouch being closed at said bottom of said slipper sock, an exterior surface in close proximity to said interior surface of said outer pouch interior surface, an interior surface conformable to a shape of said foot, said inner pouch and outer pouch being attached adjacent said outer pouch entranceway and said inner pouch entranceway at said top of said slipper sock wherein said outer pouch comprises an outer pouch border surrounding said outer pouch entranceway and extending from said outer pouch body, said inner pouch comprises an inner pouch border surrounding said inner pouch entranceway and extending from said inner pouch body, said inner pouch border and outer pouch border being inseparably fastened together about their entire circumferences to form a collar of said slipper sock surrounding said inner pouch entranceway, and said inner pouch border is folded over said outer pouch border whereby an outward facing surface of said collar is formed by the interior surface of said inner pouch at said inner pouch border.

2. A slipper sock according to claim 1 wherein said inner pouch and said outer pouch are fastened together only at said inner pouch border and said outer pouch border.

3. A slipper sock according to claim 1 comprising stitches for fastening together said inner pouch border and outer pouch border.

4. A slipper sock according to claim 1 comprising an adhesive for fastening together said inner pouch border and outer pouch border.

5. A slipper sock according to claim 1 wherein said outer pouch comprises a body formed from a knitted tube sewn closed at one end.

6. A slipper sock according to claim 5 wherein said knitted tube comprises both elastic yarns and nonelastic yarns.

7. A slipper sock according to claim 6 wherein said elastic yarns comprise 1-3% of the total yarns in said body.

8. A slipper sock according to claim 1 wherein said inner pouch comprises a single web of fabric with seams sewn to form a three-dimensional pouch.

9. A slipper sock according to claim 8 wherein said fabric has a pile with a fluffy texture.

10. A slipper sock according to claim 1 wherein the shape of the outer pouch forms the shape of the slipper sock and the inner pouch is sufficiently pliable to conform to the shape of the outer pouch when the inner pouch is inserted into the outer pouch.

11. A slipper sock according to claim 1 further having at least one gripper comprising a rubber-like high friction material mounted on said exterior surface at a bottom of said outer pouch body for preventing slips and falls.

12. A slipper sock according to claim 11 comprising a plurality of spaced grippers.

* * * * *